US010914196B2

(12) United States Patent
Blanrue et al.

(10) Patent No.: US 10,914,196 B2
(45) Date of Patent: Feb. 9, 2021

(54) MODULE OF A TURBOMACHINE OR OF A COMBUSTION CHAMBER TEST BENCH

(71) Applicant: SAFRAN AIRCRAFT ENGINES, Paris (FR)

(72) Inventors: Marc Bernard Blanrue, Moissy-Cramayel (FR); Jean-François Bernard Adnot, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 135 days.

(21) Appl. No.: 15/778,612

(22) PCT Filed: Nov. 16, 2016

(86) PCT No.: PCT/FR2016/052972
§ 371 (c)(1),
(2) Date: May 23, 2018

(87) PCT Pub. No.: WO2017/089677
PCT Pub. Date: Jun. 1, 2017

(65) Prior Publication Data

US 2018/0291767 A1 Oct. 11, 2018

(30) Foreign Application Priority Data

Nov. 27, 2015 (FR) ..... 15 61444

(51) Int. Cl.
*F01D 25/24* (2006.01)
*F01D 25/26* (2006.01)

(52) U.S. Cl.
CPC ..... *F01D 25/243* (2013.01); *F01D 25/265* (2013.01); *F05D 2230/64* (2013.01)

(58) Field of Classification Search
CPC ... F01D 25/243; F01D 25/265; F05D 2230/64
See application file for complete search history.

(56) References Cited

U.S. PATENT DOCUMENTS 3,824,034 A 7/1974 Leicht
2011/0250061 A1* 10/2011 Blanchard ..... F01D 9/042 415/208.2

FOREIGN PATENT DOCUMENTS

FR 2 136 773 A5 12/1972
FR 2 228 967 A1 12/1974

OTHER PUBLICATIONS

International Search Report and English Translation dated Mar. 3, 2017, for International Application No. PCT/FR2016/052972, filed Nov. 16, 2016, 5 pages.

(Continued)

*Primary Examiner* — Daniel S Larkin
*Assistant Examiner* — Anthony W Megna Fuentes
(74) *Attorney, Agent, or Firm* — Christensen O'Connor Johnson Kindness PLLC

(57) ABSTRACT

The present disclosure concerns an assembly of a turbomachine or of a combustion chamber test bench, generally including an annular outer housing, inside which a combustion chamber is housed, and a ferrule downstream from the housing. The ferrule may be attached to said housing by a connection comprising a radial flange rigidly connected to one of the housing and the ferrule, an annular groove being provided in the radial flange, and an axial tab rigidly connected to the ferrule or to the housing. The tab is generally housed in the groove, and the tab and the annular groove may be arranged relative to each other in such a way that, at assembly, they are in contact and centered relative to each another.

16 Claims, 3 Drawing Sheets

(56) References Cited

OTHER PUBLICATIONS

Written Opinion dated Mar. 3, 2017, for International Application No. PCT/FR2016/052972, filed Nov. 16, 2016, 6 pages.

* cited by examiner

Fig. 4
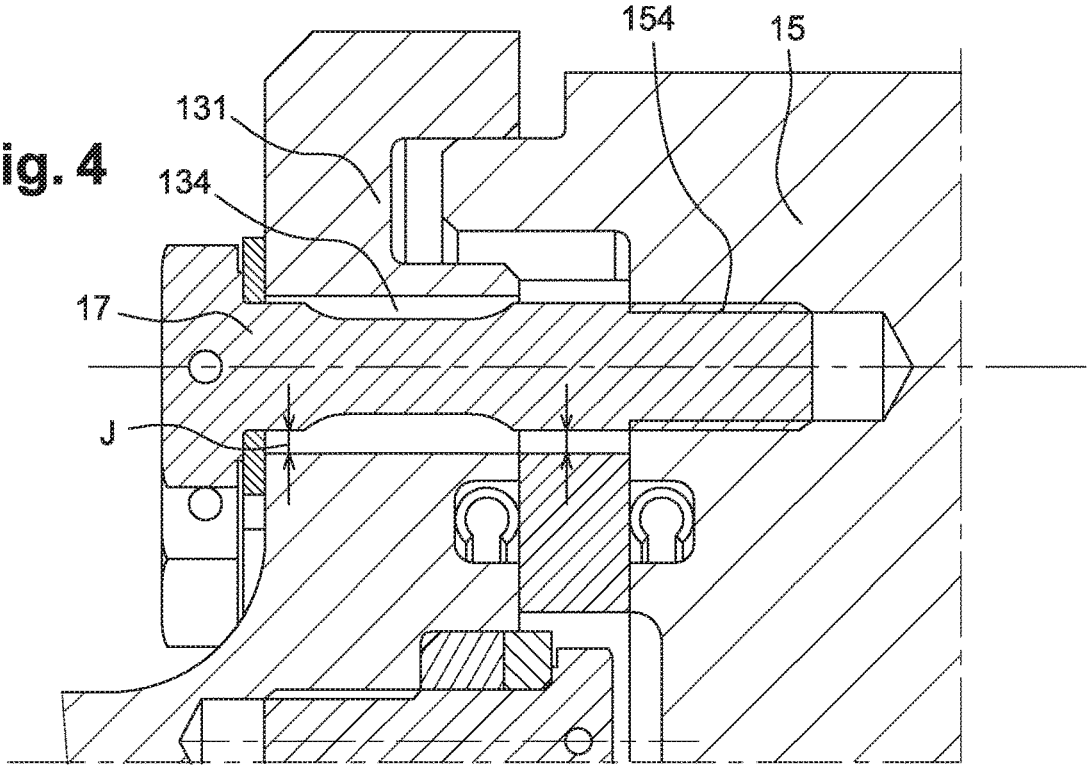
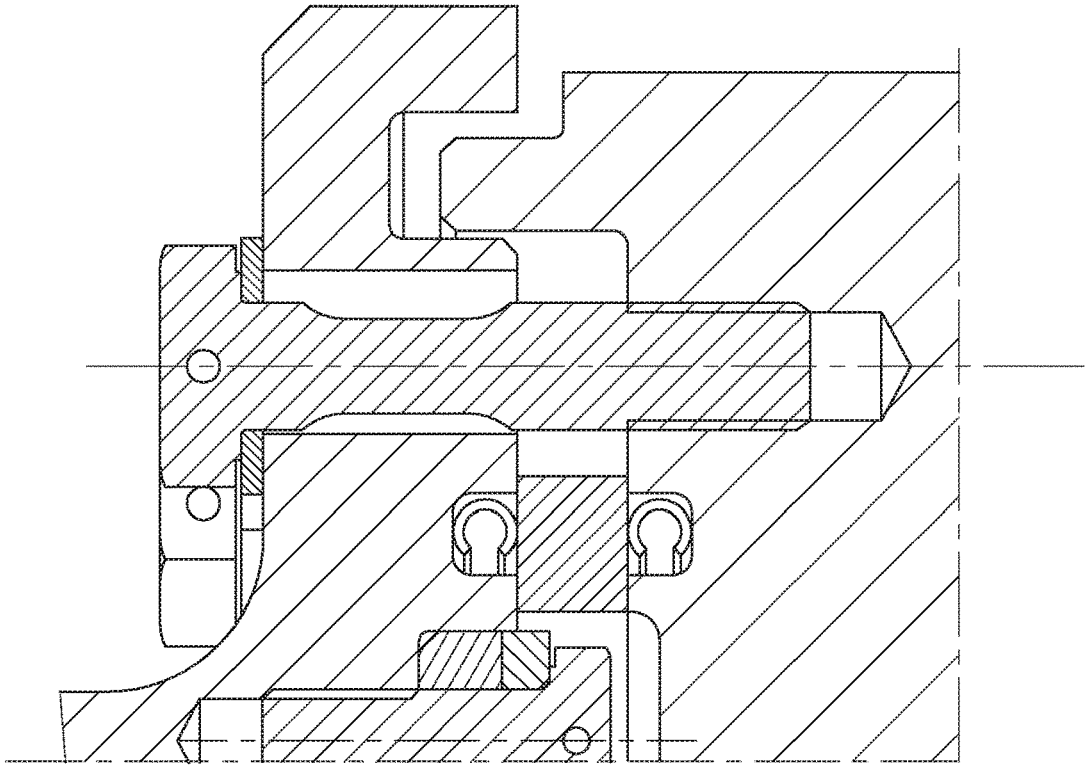
Fig. 5

MODULE OF A TURBOMACHINE OR OF A COMBUSTION CHAMBER TEST BENCH

TECHNICAL FIELD

Embodiments of the present disclosure concern, in particular, the field of gas turbine engine combustion chamber tests. They concern a module of a turbomachine or combustion chamber test bench and aim more specifically for the assembly of ferrules on the module.

BACKGROUND

The state of the art comprises, in particular, documents FR-A1-2 228 967 and FR-A5-2 136 773.

A test bench is a facility wherein engines or their components, here a combustion chamber, are subjected to tests aiming to measure their performances. In patent FR 2.995.996 in the name of the present applicant, for example, is defined a device intended to measure functioning parameters of a gas turbine engine combustion chamber assembled on a test bench.

FIG. 1 represents a combustion chamber 10 assembled on a test bench 1. The combustion chamber is assembled on an attached support which comprises appropriate air and fuel supply ducts, and it is not necessary to define further in the scope of the present disclosure. The annular chamber 10 is assembled between a lower housing and an outer housing simulating the space wherein it is housed in the actual engine. The outer housing 3 itself is attached upstream of the bench structure. The housing 3 is extended downstream by a ferrule 5 being used, among other functions, to guide the gaseous flows coming from the combustion chamber. FIG. 2 shows how the ferrule 5 is commonly connected to the housing 3 by a connection by screws 7 between a radial flange 31 downstream of the outer housing 3 and the transverse face upstream of the ferrule 5. The centering of the ferrule in relation to the housing is ensured by a centering tongue 51 rigidly connected to one of the two parts, here the ferrule, and remaining supported on a surface of the part opposite it, here the radially outer face of the flange 31. A wedge 8 is arranged between the two parts.

In the framework of combustion chamber tests, it is necessary to considerably cool all the ferrules located downstream of the chamber, and in particular, the ferrule 5.

The ferrule 5 is, for example, maintained at less than 120° C. Yet, the outer housing 3 of the chamber 10, during tests, reaches a temperature of around 650° C. These temperatures lead to a considerable difference in dilatation between the two parts which apply the screw connection by shearing. As this is indicated by the arrows in FIG. 2, the lengths of these arrows show a dilatation of 0.1 mm for the ferrule 5 whereas it is 1.2 mm for the housing 3.

Moreover, it is absolutely necessary to guarantee a strong centering of the two parts at assembly as at functioning. Thus, when the ferrule 5 is centered on the housing 3, at assembly by the contact of the centering tongue 51 on the flange 31, by functioning, a strong application of the centering tongue 51 ensues. These stresses can lead to splits, even rupture of the part.

A solution would be to thicken the housings and to use very large screws, which would support the shearing forces. This solution would, however, be highly radially obstructing, which is not desired. For known reasons, it is not desired also to increase the mass.

The disclosure aims for a strong centering between the two parts, made of steel for example, just as strong while functioning, in other words when hot, as at assembly, in other words when cold, without shearing the parts and connecting by screws.

SUMMARY

Thus, the disclosure is based on a module of a turbomachine or combustion chamber test bench, comprising an annular outer housing of axis A of revolution, inside which is housed a combustion chamber, and a ferrule downstream of the housing, the ferrule being attached to the housing by a connection comprising a radial flange rigidly connected to the housing or to the ferrule, an axially-leading annular groove, being provided in the radial flange and an axial tab rigidly connected to the ferrule or to the housing, the tab being housed in the groove. The module is characterised by the fact that the tab and the annular groove are arranged relative to each other in such a way that, at assembly they are in radial contact and centered relative to each other.

According to a first embodiment wherein the housing is rigidly connected to the flange and the tab is rigidly connected to the ferrule, the two outer diameters of the groove and the tab are equal to ensure the centering of the ferrule relative to the housing, at assembly, by radial contact between the tab and the groove.

Advantageously, the two inner diameters of the groove and of the tab are configured to be equal while functioning, so as to ensure the centering of the ferrule relative to the housing while functioning, by radial contact between the tab and the groove.

By letting the outer housing dilate relative to the ferrule, creating shearing stresses is avoided. In addition, the centering is also ensured at assembly as it is while functioning, thanks to two different radial contacts.

More specifically, the width of the groove and the width of the tab are chosen such that their difference is equal to the increase in radius, resulting in the dilatation of the housing with the flange thereof and the ferrule between the assembly and the functioning, such that the ferrule is centered on the housing while functioning by radial contact between the tab and the groove.

Preferably, the ferrule is attached to the housing by screws crossing the flange through orifices in the flange, and the diameter of the orifices is sufficient to enable the dilatation of the housing without shearing stress on the screws.

According to another embodiment, the housing is rigidly connected to the tab and the flange is rigidly connected to the ferrule, the two inner diameters of the groove and of the tab being equal, so as to ensure the centering of the ferrule relative to the housing, at assembly, by radial contact between the tab and the groove.

Conforming with another characteristic, the two outer diameters of the groove and of the tab are configured to be equal while functioning so as to ensure the centering of the ferrule relative to the housing while functioning by radial contact between the tab and the groove.

More specifically, the width of the groove and the width of the tab are chosen such that their difference is equal to the increase in radius, resulting in the dilatation of the housing and of the ferrule between the assembly and the functioning of the bench, such that the ferrule is centered on the housing while the bench functions, by radial contact between the tab and the groove.

The ferrule is attached to the housing by screws crossing the orifices of the flange, the diameter of the orifices being sufficient to enable the dilatation of the housing without shearing stress on the screws.

Thus, relative to the cooled/uncooled connections of the prior art, the disclosure provides:

A more reduced obstruction as there is no need for large screws,

An increase in mass because of the decrease in thickness of the housings and of the diameter of the screws, Centering at assembly and while functioning is guaranteed, Stresses in the screws and in the centering are relaxed.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

FIG. 4 shows the connection that conforms with the disclosure between the housing of the combustion chamber assembled on the test bench and the ferrule attached downstream of the outer housing with other references; and FIG. 5 shows the connection while functioning, the centering being achieved by radial contact of the tab with the lower edge of the groove.

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

Figure 1:
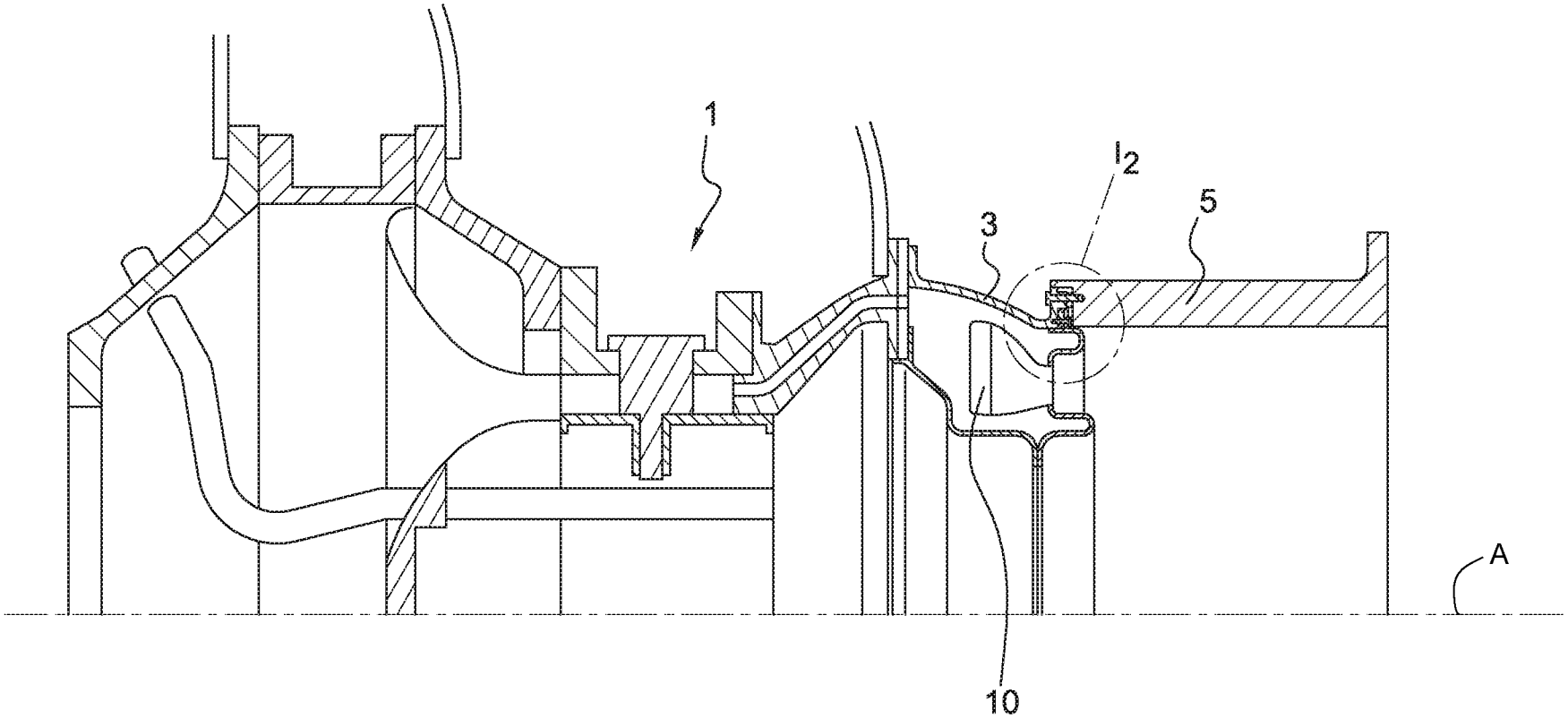
FIG. 1 represents, in an axial half cross-section, a combustion chamber assembled on a test bench.
Figure 2:
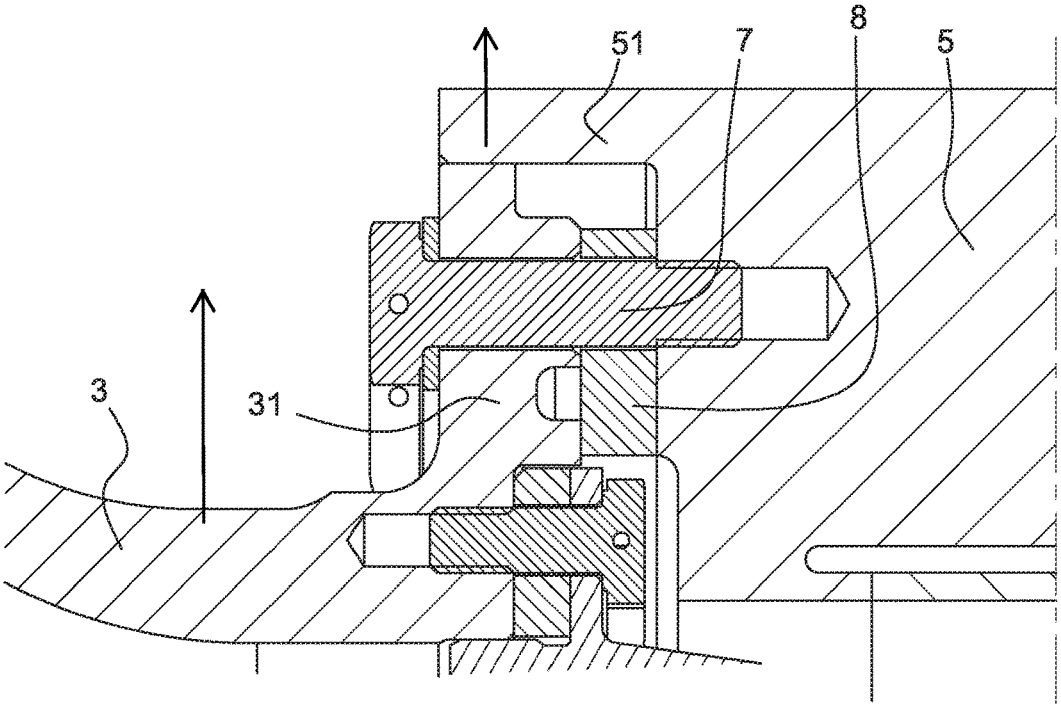
FIG. 2 is a larger-scale view of the detail 12 in FIG. 1 and shows the connection of the prior art between the outer housing of the combustion chamber in FIG. 1 and the ferrule assembled downstream of it.
Figure 3:
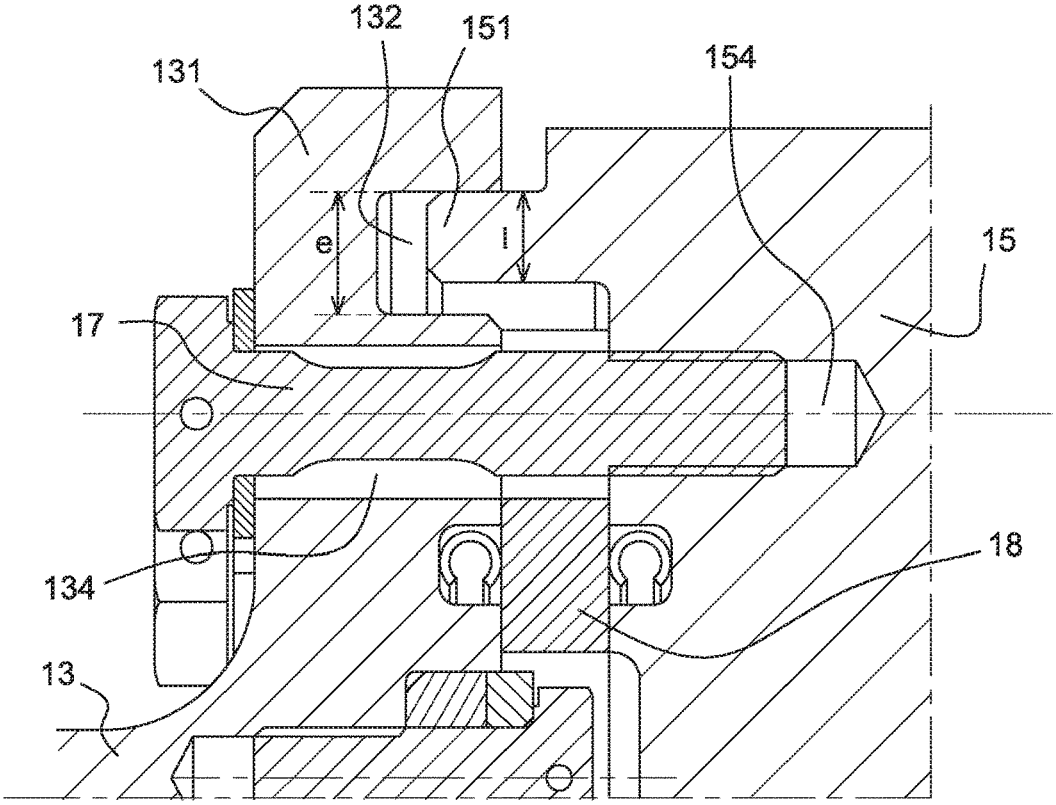
FIG. 3 shows the connection that conforms with the disclosure between the housing of the combustion chamber assembled on the test bench and the ferrule attached downstream of the outer housing.

FIG. 3 represents the modified connection between the housing and the ferrule relative to that in FIG. 2, conforming with the disclosure. This connection is represented at assembly, in other words, at room temperature before any test. The radial flange now supports the reference 131, the outer housing of the combustion chamber of the test bench, the reference 13 and the ferrule, reference 15.

A groove 132 has been machined in the flange 131 on the face situated on the side of the ferrule. The ferrule 15 comprises an annular tab 151 which is inserted in the groove 132. The outer diameter of the tab 151 is equal to that of the outer diameter of the groove 132. By this radial contact over the whole of the periphery of the ferrule 15, the tab 151 ensures, when cold, the centering of the ferrule relative to the outer housing 13.

The two parts 13 and 15 are kept assembled by the screws or screw means 17 which cross the flange 131 through the orifices 134 and are screwed on the upstream face of the ferrule in the holes 154 suitably tapped. A wedge 18 made of appropriate material forms an interface between the housing and the ferrule. The sealing can be achieved by metal seals C on either side of the wedge 18.

During testing the combustion chamber on the bench, the temperature of the outer housing 13 highly increases, whereas it is brought to be maintained by cooling the temperature of the ferrule 15; a differential dilatation between these two parts ensues, as explained above.

To not counteract the dilatation of the housing, while preserving the centering of the ferrule; the centering when hot is calculated relative to the differences in dilatations between the two parts. The width of the groove 132 has been determined such that, during the tests at the functioning temperature of the combustion chamber, the inner blank comes into radial contact with the inner face of the tab 151 without any tightening between the parts. It ensues that the centering of the ferrule relative to the housing is ensured when hot without the parts being applied by shearing.

To be certain that a relative radial movement between the outer housing 13 and the ferrule 15 is had, it is verified, by calculation, that the screw heads slide on the flange of the housing. To not shear the screws, moreover a gap J in the holes 134 is provided for screws to pass through (FIG. 4). This gap must be sufficient to avoid any contact. When the available space is restrained, it is possible to stagger the holes 134 for screws to pass through in the outer housing relative to the axis of the threads.

To summarise, this system enables a centering of the ferrule 15 relative to the outer housing 13 of the chamber on two separate functioning points: at assembly when cold (FIG. 4) and while functioning when hot (FIG. 5); everything in an environment is very restrained. It also enables an increase in mass, significant because of a decrease in the thickness of the flanges, and because of the reduction of the diameter of the screws.

On the other hand, because of the sliding enabled between the parts, the stresses are reduced.

The disclosure according to an embodiment has been defined, the other embodiment is clearly deduced from this.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The invention claimed is:

1. An assembly of a turbomachine or combustion chamber test bench, the assembly comprising: an annular outer housing having an axis A of revolution and housing a combustion chamber; and a ferrule downstream of the housing to guide gaseous flows coming from the combustion chamber, the ferrule being attached to said housing by a connection comprising: a radial flange rigidly connected to one of the housing or the ferrule; an axially-leading annular groove in the radial flange; and an axial tab rigidly connected to one of the ferrule or the housing, the tab being housed in the groove and the tab extends paralelly with respect to axis A, wherein the tab and the annular groove are arranged relative to each other such that, at assembly, the tab and the annular groove are in radial contact and centered relative to each other.

2. The assembly of claim 1, wherein the housing is rigidly connected to the flange, the tab is rigidly connected to the ferrule, and the groove and the tab configured to ensure centering of the ferrule relative to the housing, at assembly, by radial contact between the tab and the groove.

3. The assembly of claim 2, wherein the width of the groove and the width of the tab are chosen such that their difference is equal to the increase in radius resulting from the dilatation of the housing with the flange thereof and of the ferrule between the assembly and the functioning of the bench, such that the ferrule is centered on the housing while the bench functions by radial contact between the tab and the groove.

4. The assembly of claim 1, wherein the ferrule is attached to the housing by screws crossing orifices of the flange, the diameter of said orifices being sufficient to enable the dilatation of the housing without imparting shear stress on the screws.

5. The assembly of claim 1, wherein the housing is rigidly connected to the tab and the flange is rigidly connected to the ferrule, the groove and the tab configured to ensure centering of the ferrule relative to the housing, at assembly, by radial contact between the tab and the groove.

6. The assembly of claim 5, wherein the width of the groove and the width of the tab are chosen such that their difference is equal to the increase in radius resulting from the dilatation of the housing and of the ferrule between the assembly and the functioning of the bench, such that the ferrule is centered on the housing while the bench functions, by radial contact between the tab and the groove.

7. The assembly of claim 5, wherein the ferrule is attached to the housing by screws crossing orifices of the flange, the diameter of said orifices being sufficient to enable the dilatation of the housing without imparting shear stress on the screws.

8. An assembly of a turbomachine or combustion chamber test bench, the assembly comprising: an annular outer housing having an axis A of revolution and housing a combustion chamber; and a ferrule positioned downstream of the housing to guide gaseous flows coming from the combustion chamber, the ferrule being attached to said housing by a connection comprising: a radial flange rigidly connected to one of the housing or the ferrule; an axially-leading annular groove in the radial flange, the groove having an inner side wall and an outer side wall spaced a width $W_g$ annularly outwardly from the inner side wall of the groove; and an axial tab rigidly connected to the other one of the ferrule or the housing, the tab being housed in the groove and having a width Wt defined by an annularly outwardly facing contact surface and an annularly inwardly facing contact surface and the tab extends parallel with respect to axis A, wherein the tab and the annular groove are arranged relative to each other such that, at assembly, the tab and the annular groove are in radial contact and centered relative to each other.

9. The assembly of claim 8, wherein the housing is rigidly connected to the flange and the tab is rigidly connected to the ferrule, and wherein the groove and the tab are arranged such that when assembled the outer side wall of the groove contacts the outwardly facing contact surface of the tab to ensure centering of the ferrule relative to the housing.

10. The assembly of claim 9, wherein the groove and the tab are arranged such that when functioning the inner side wall of the groove contacts the inwardly facing contact surface of the tab to ensure centering of the ferrule relative to the housing.

11. The assembly of claim 10, wherein the width $W_g$ of the groove and the width Wt of the tab are chosen such that the difference between width $W_g$ and width Wt is equal to the increase in radius resulting from the dilatation of the housing with the flange thereof and of the ferrule between the assembly and the functioning of the bench, such that the ferrule is centered on the housing while the bench functions, by radial contact between the tab and the groove.

12. The assembly of claim 8, wherein the ferrule is attached to the housing by screws crossing orifices of the flange, the diameter of said orifices being sufficient to enable the dilatation of the housing without imparting shear stress on the screws.

13. The assembly of claim 8, wherein the housing is rigidly connected to the tab and the flange is rigidly connected to the ferrule, and wherein the groove and the tab are arranged such that when assembled the inner side wall of the groove contacts the inwardly facing contact surface of the tab to ensure centering of the ferrule relative to the housing.

14. The assembly of claim 13, wherein the groove and the tab are arranged such that when functioning the outer side wall of the groove contacts the outwardly facing contact surface of the tab to ensure centering of the ferrule relative to the housing.

15. The assembly of claim 14, wherein the width $W_g$ of the groove and the width Wt of the tab are chosen such that the difference between width $W_g$ and width Wt is equal to the increase in radius resulting from the dilatation of the housing and of the ferrule between the assembly and the functioning of the bench, such that the ferrule is centered on the housing while the bench functions, by radial contact between the tab and the groove.

16. The assembly of claim 13, wherein the ferrule is attached to the housing by screws crossing orifices of the flange, the diameter of said orifices being sufficient to enable the dilatation of the housing without imparting shear stress on the screws.

* * * * *